United States Patent [19]

Sagawa et al.

[11] Patent Number: 5,055,809

[45] Date of Patent: Oct. 8, 1991

[54] RESONATOR AND A FILTER INCLUDING THE SAME

[75] Inventors: Morikazu Sagawa, Tokyo; Haruyoshi Endo, Zama; Mitsuo Makimoto, Yokohama; Fumio Fukushima, Miyazaki, all of Japan

[73] Assignee: Matsushita Electric Industrial Co., Ltd., Kodoma, Japan

[21] Appl. No.: 529,700

[22] Filed: May 31, 1990

Related U.S. Application Data

[63] Continuation of Ser. No. 388,874, Aug. 3, 1989.

[30] Foreign Application Priority Data

| | | | |
|---|---|---|---|
| Aug. 4, 1988 | [JP] | Japan | 63-195000 |
| Mar. 20, 1989 | [JP] | Japan | 1-68229 |
| Mar. 23, 1989 | [JP] | Japan | 1-70852 |

[51] Int. Cl.[5] ..... H01P 7/08; H01P 1/203

[52] U.S. Cl. ..... 333/219; 333/204

[58] Field of Search ..... 333/202–205, 333/219, 219.1, 238, 246

[56] References Cited

U.S. PATENT DOCUMENTS

| | | | |
|---|---|---|---|
| 4,020,429 | 4/1977 | Bickley | 333/205 |
| 4,749,963 | 6/1988 | Makimoto et al. | 331/99 |

FOREIGN PATENT DOCUMENTS

| | | | |
|---|---|---|---|
| 1926501 | 11/1970 | Fed. Rep. of Germany | 333/204 |
| 0042301 | 3/1983 | Japan | 333/204 |
| 0030401 | 2/1987 | Japan | 333/204 |
| 1261032 | 9/1986 | U.S.S.R. | 333/204 |
| 1298817 | 3/1987 | U.S.S.R. | 333/204 |
| 1352563 | 11/1987 | U.S.S.R. | 333/204 |
| 0963535 | 7/1964 | United Kingdom . | |
| 1119669 | 7/1968 | United Kingdom . | |
| 1290650 | 9/1972 | United Kingdom . | |
| 2164804 | 3/1986 | United Kingdom . | |

*Primary Examiner*—Eugene R. LaRoche
*Assistant Examiner*—Seung Ham
*Attorney, Agent, or Firm*—Lowe, Price, LeBlanc & Becker

[57] ABSTRACT

A resonator having a strip line, the strip line comprising: a first portion forming an open loop; and two second portions, each provided to each end of the first portion, the second portions facing each other with a given distance therebetween, the distance and length of the second portion being determined such that necessary capacitance is provided. The capacitor is provided instead of a discrete capacitor for saving space and for reducing dielectric loss therein. A second resonator further comprises second and third capacitor having a semicircle strip-line patterns for providing capacitances between ends of the first portion and grounded planes which decrease the resonance frequency so that size of the second resonator are reduced. A third resonator also comprises the first capacitor, but arranged outside of the first portion. Capacitance of the first capacitor can be increased by teeth provided to the second portions. A filter comprises plural third resonators so arranged that coupling between the resonators is obtained by one selected from magnetic-field coupling through the first portions, electromagnetic-field coupling through first and second portions, and electric-field coupling through second portions.

18 Claims, 9 Drawing Sheets

RESONATOR AND A FILTER INCLUDING THE SAME

This application is a continuation of application Ser. No. 07/388,874 filed Aug. 3, 1989.

BACKGROUND OF THE INVENTION

1. Field of the Invention

This invention relates to a resonator and a filter including the same for radio equipment and high-frequency measuring instruments.

2. Description of the Prior Art

A resonator which comprises a microwave integrated circuit (MIC) having strip lines is used in an oscillator and a filter employed in high frequency (UHF to SHF) radio equipment. Resonators suited for the microwave integrated circuit are required to be miniaturized and be ungrounded. A split-ring-shaped resonator as such a resonator is disclosed in FIGS. 7(*a*) to 9(*b*) of U.S. Pat. No. 4,749,963. This type resonator comprises a ring-shaped strip line and coupling capacity for coupling ends of the ring-shaped strip line. This resonator is capable of largely reducing the length of the strip line less than a half-wave length because the coupling capacitor is provided to the ring-shaped strip line. However, there are drawbacks that dielectric loss in the coupling capacitor tends to deteriorate an unloaded Q factor of the resonator; the dimension of the resonator is still large because there is useless space; there is unevenness of resonance frequencies among resonators manufactured; it is difficult to trim a resonance frequency of the manufactured resonator; and the resonator has a capacitor, increasing manufacturing cost. Similarly, in a filter comprising the above-mentioned resonators, there are drawbacks that dielectric loss in the coupling capacitor of the resonator tends to deteriorate insertion loss of the filter; the dimension of the filter is still large; there is unevenness of resonance frequencies among filters manufactured; it is difficult to trim a resonance frequency of the manufactured resonator of the filter; and the resonators of the filter have a capacitor, increasing manufacturing cost.

SUMMARY OF THE INVENTION

The present invention has been developed in order to remove the above-described drawbacks inherent to the conventional resonator and filter including the same.

According to the present invention there is provided first resonator having a strip line, the strip line comprising: a first portion so curved to form an open loop; and two second portions, each provided to each end of the first portion, the second portions facing each other with a given distance therebetween, the distance and length of the second portion being determined such that necessary capacitance is provided.

According to the present invention there is also provided second resonator having a strip line, the strip line comprising: a first portion so curved to form an open loop; and two second portions, each provided to each end of the first portion, the second portions facing each other with a given distance therebetween, the distance and length of the second portion being determined such that necessary capacitance is provided, each of the two second portions having a relatively large area such that an additional capacitance is provided between each of the second portions and a grounded plane supporting the strip line through a dielectric substance.

According to the present invention there is further provided third resonator having a substantially hairpin-shaped strip line, the strip line comprising: a first portion so curved to form an open loop; and two second portions formed to have larger width than the first portion, each provided to each end of the first portion, the second portions facing each other with a given distance therebetween, the distance and length of the second portion being determined such that necessary capacitance is provided.

According to the present invention there is further provided a filter including a plurality of the third resonators, the plurality of resonators serially arranged so as to obtain coupling between two consecutive resonators through the first portions of the plurality of resonators.

BRIEF DESCRIPTION OF THE DRAWINGS

The object and features of the present invention will become more readily apparent from the following detailed description taken in conjunction with the accompanying drawings in which.

The same or corresponding elements or parts are designated at like references throughout the drawings.

DETAILED DESCRIPTION OF THE INVENTION

Figure 1A:
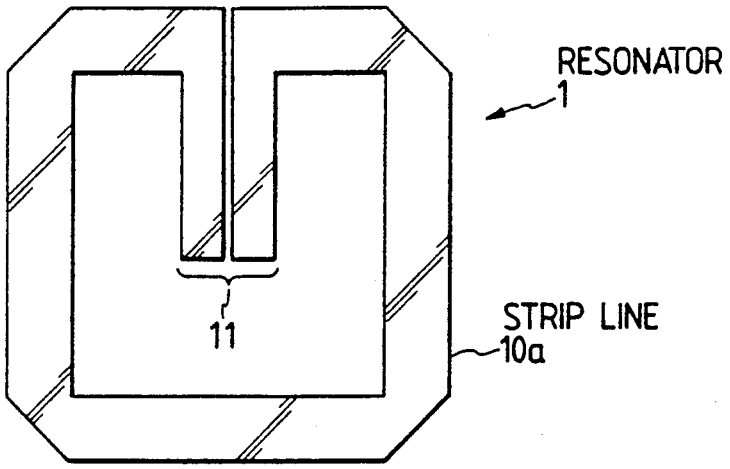
FIG. 1A is a plan view of a resonator of a first embodiment of the present invention.

Referring now to the drawings, FIG. 1A is a plan view of a first embodiment of a resonator 1 of the present invention.

Figure 4:
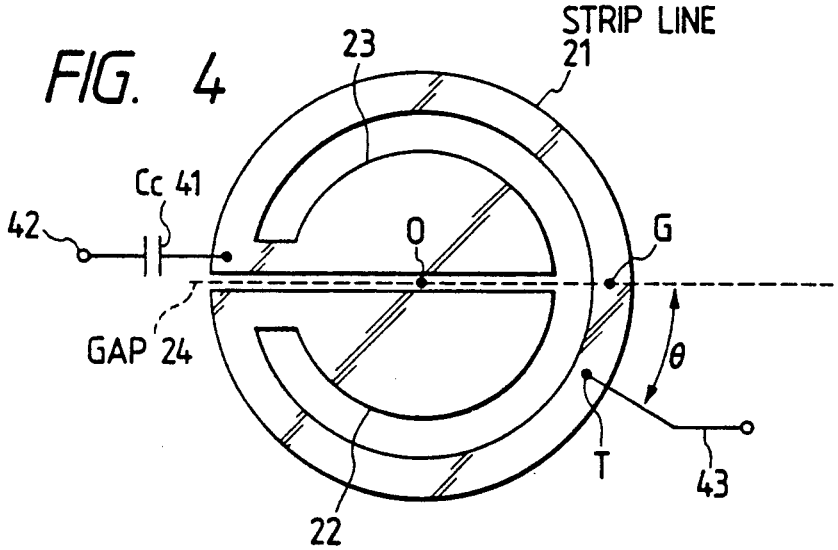
FIG. 4 shows methods for coupling of the resonator of FIG. 2A.

In FIG. 1A, the resonator 1 comprises a strip line 10*a* forming a substantially complete loop having spaced-apart ends, i.e., an open loop or first portion; and a capacitive means having two given length of parallel strip lines 11 spaced apart each other, ends of the strip lines 11, i.e., second portion, being connected to the ends of the strip line 10*a* respectively, and arranged inside the strip line 10*a*. As shown in FIG. 4, the strip line 10*a* is coupled to an external circuit through a capacitor Cc41 or coupled through a conductor 43. In this specification and claims, the term "strip line" includes microstrip and balanced strip lines. The microstrip line comprises a strip conductor (strip line 21); a dielectric substrate 80 on which the strip line is placed; and a grounded plane 81 on which the dielectric substrate (substance) 80 is placed, as shown in FIG. 2C. The balanced strip line comprises two unshown grounded planes two unshown dielectric substrates sandwiched between the unshown ground planes, and a strip conductor interposed between the dielectric substrates.

Figure 1B:
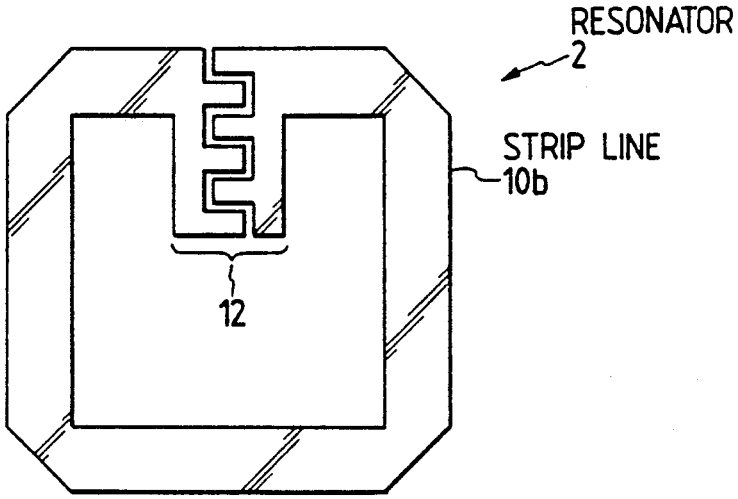
FIG. 1B is a plan view of a resonator of a second embodiment.
Figure 1C:
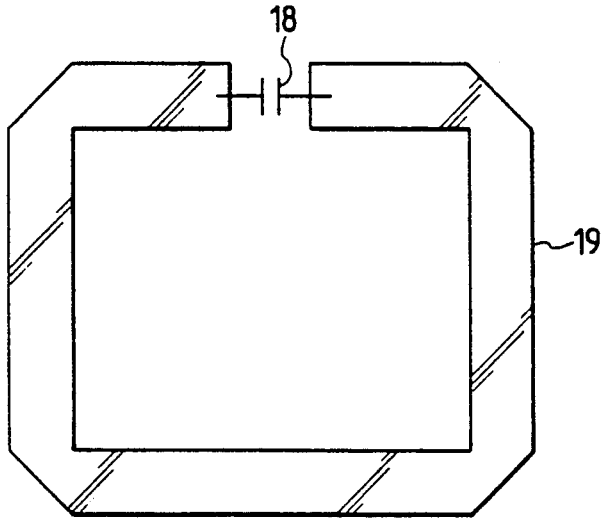
FIG. 1C shows an equivalent circuit of the first and second embodiments.

FIG. 1C shows an equivalent circuit of the resonator 1. In FIG. 1C, a capacitor 18 is equivalent to parallel strip lines 11 which are replaced with a capacitor of the conventional split-ring-shaped resonator. The parallel strip lines 11 are formed to be connected to ends of the strip line 10*a*, inside the strip line 10*a*. Therefore, this makes the dimensions of the resonator 1 small. Further, the strip line 10*a* and parallel strip line 11 are formed by the same process, for example, a photolithographic process. Accordingly, this makes the manufacturing cost reduced and provides the resonator 1 with a precise dimensions and thus an accurate resonance frequency of the resonator 1. When strip line 10*a* and parallel strip lines 11 are formed by photolithographic process they are accurately formed so that the resonance frequency is accurate. If a resonance frequency of a manufactured resonators deviates from a desired value, it is easy to trim the resonance frequency by adjusting the length of the parallel strip lines 11. Moreover, an unloaded Q factor of the resonator is large because dielectric loss in the parallel strip lines 11 is extremely smaller than that of a discrete capacitor used in the conventional resonators generally having large dielectric loss. In designing parallel strip lines 11 and strip line 10*a*, ideal impedance matching is made by selecting widths and lengths of parallel strip line 11 and strip line 10*a*, i.e., to have a relation $Z_{o1}^2 = Z_o o . Z_o e$ wherein $Z_o o$ and $Z_o e$ are odd and even mode characteristic impedances of the parallel strip lines 11 respectively and $Z_{o1}$ is a characteristic impedance of the strip line 10*a*. Such designing reduces reflection between the strip line 10*a* and parallel strip lines 11.

FIG. 1B is a plan view of a second embodiment of a resonator 2 of the present invention. In FIG. 1B, a resonator 2 comprises a strip line 10*b* forming a substantially complete loop having spaced-apart ends, i.e., an open loop; and a capacitive means having two given length of strip lines 12 spaced apart each other, ends of two given length of strip lines 12 being connected to the ends of the strip line 10*b* respectively. The strip lines 12 have teeth like a comb which are interlaced with each other, i.e., interdigitated with each other. It is assumed that length of strip lines 12 is equal to that of the parallel strip lines 11 of the first embodiment, the strip lines 12 have a larger capacitance than the strip line 11. Therefore, there is an advantage that dimensions of the resonator 2 becomes smaller than the resonator 1 of the first embodiment. Assuming that length of strip lines 12 is equal to that of the parallel strip lines 11 of the first embodiment and their capacitances are equal to each other, space between the strip lines 12 is wider so that unevenness of resonance frequencies among manufactured resonators is smaller than that of the resonator 1 of the first embodiment.

Figure 2A:
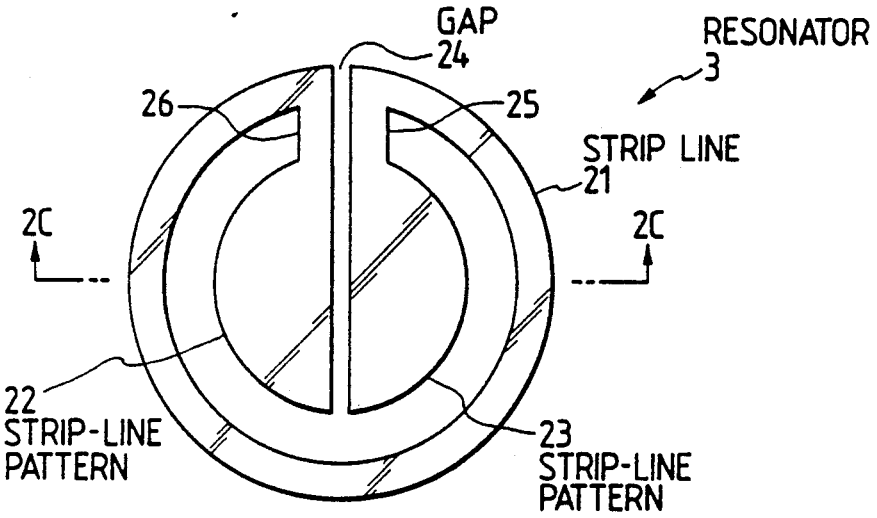
FIG. 2A is a plan view of a resonator of a third embodiment.

FIG. 2A is a plan view of a third embodiment of a resonator 3 of the present invention. In FIG. 2A, a resonator 3 comprises a strip line 21 forming a substantially complete circular loop having spaced-apart ends, i.e., an open loop; and a capacitive means having two strip-line patterns 22 and 23. The strip-line patterns 22 and 23 are respectively formed, in semicircles shape, spaced apart in parallel by a gap 24 with diameters of the semicircles confronting with each other, and inside the strip line 21. The strip-line patterns 22 and 23 are connected to ends of the strip line 21 by parallel strip lines 25 and 26 respectively.

Figure 2B:
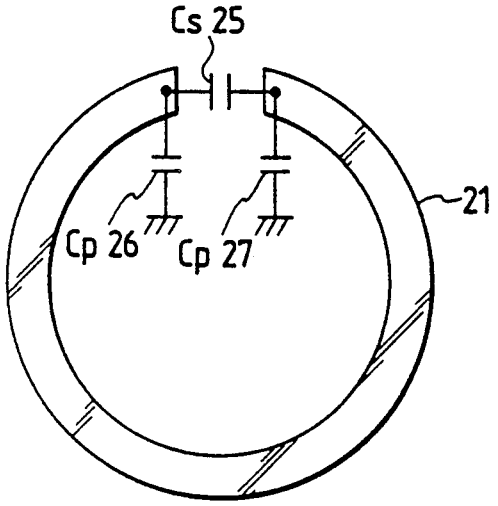
FIG. 2B shows an equivalent circuit of the third embodiment.
Figure 2C:
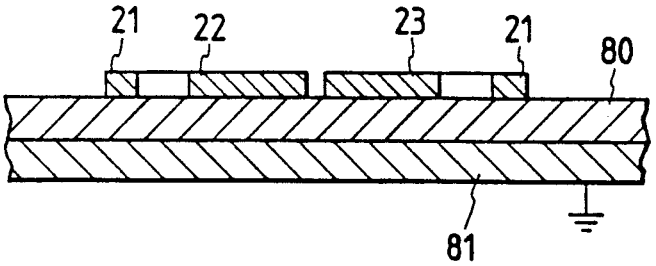
FIG. 2C is a cross-sectional view of a resonator of a third embodiment.

FIG. 2B shows an equivalent circuit of the resonator 3. In FIG. 2B, series capacitance Cs 25 is made between these strip-line patterns 22 and 23 through the gap 24. Parallel capacitances Cp 26 and Cp 27 are made between the conducting pattern 22 and a grounded plane 81 and the conducting pattern 23 and the grounded plane 81 through a dielectric substance 80 respectively, as shown in FIG. 2C. The larger capacities of the capacitance Cp 26 and Cp 27 the lower resonance frequency of the resonator 3. Therefore, it is assumed that the resonance frequency of the resonator 3 is constant, the dimension of the strip line 21 becomes small because capacitance Cp 26 and Cp 27 is larger than capacitances between parallel strip lines 11 of the first embodiment or strip lines 12 of the second embodiment and the ground planes 81 and the strip-line patterns 22 and 23 are formed inside the strip line 21. Moreover, the strip line 21 has no rectangular corner so that stability of resonance frequency is higher than that of the first and second embodiment.

Figure 3:
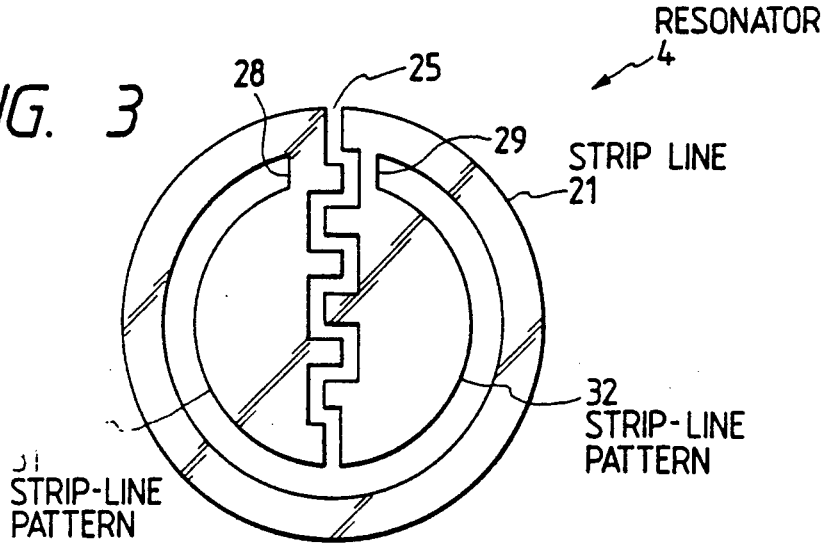
FIG. 3 is a plan view of a resonator of a fourth embodiment.

FIG. 3 is a plan view of a fourth embodiment of a resonator 4 of the present invention. In FIG. 3, a resonator 4 comprises a strip line 21 forming a substantially complete loop having spaced-apart ends, i.e., an open loop; and a capacitive means having two strip-line patterns 32 and 33. The strip-line patterns 32 and 33 are formed, in semicircle shape, spaced apart by a gap 25, and inside the strip line 21. The strip-line patterns 31 and 32 are connected to ends of the strip line 21 by strip lines 28 and 29 respectively. The strip-line patterns 31 and 32 have teeth like a comb which are interlaced with each other. Therefore, there is an advantage that dimensions of the resonator 4 becomes smaller than that of the resonator 3 of the third embodiment. Moreover, the strip line 21 has no rectangular corner so that stability of resonance frequency is higher than that of the first and second embodiment.

FIG. 4 shows methods for coupling the resonators 3 to an external circuit. There are two methods for coupling, namely, electric-field (capacitive) and magnetic-field coupling. Electric-field coupling is performed by connecting one end of strip line 21 where electric-field field is largest, to an external circuit through a capacitor Cc41. Magnetic-field coupling is performed by connecting a point T on the strip line 21, displaced from the center G of strip line 21 by an angle $\phi$ ($<GOT=\phi$), by a conductor 43. Degree of coupling can be adjusted by changing capacitance of the capacitor Cc41 or the angle $\phi$. Similarly, the resonators 1, 2, and 4 are coupled to an external circuit by the above-mentioned method.

Figure 5:
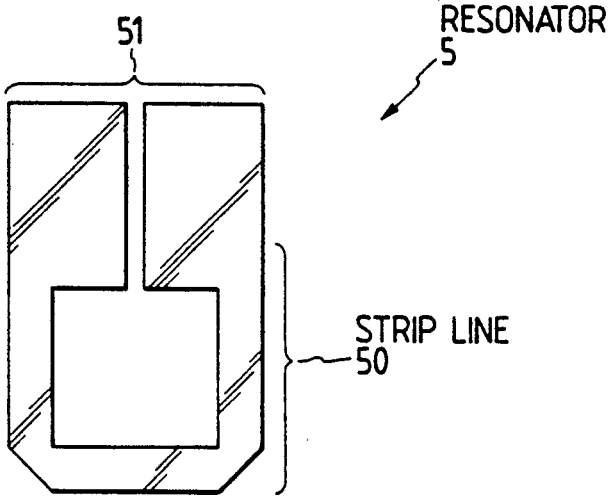
FIG. 5 is a plan view of a resonator of a fifth embodiment.

FIG. 5 is a plan view of a fifth embodiment of the present invention. In FIG. 5, a resonator 5 comprises a strip line 50 forming a substantially complete rectangular loop having spaced-apart ends, i.e., an open loop; and a capacitive means having two given length of parallel strip lines 51 spaced apart each other, ends of strip lines 51 being connected to the ends of the strip line 50 respectively, and arranged outside of the strip line 50. The parallel strip lines 51 are so designed that a square root of a product of odd and even mode characteristic impedances $Z_o o$, $Z_o e$ are smaller than a characteristic impedance $Z_o$ of strip line 50. Therefore, there is an advantage that dimensions of the resonator 5 becomes smaller because a concentrated capacity of the conventional ring-shaped of resonator is replaced with distributed capacitance, i.e., parallel strip lines 51. Further, dimensions of the resonator 5 are reduced by making odd and even mode characteristic impedances $Z_o o$, $Z_o e$ smaller than the characteristic impedance $Z_o$ of the strip line to by selecting lengths and widths of the parallel strip lines 51 and strip line 50. This is because such selection results in increase in capacitance between the grounded plane 81 and the strip line 51 through dielectric substance 80 so that the resonance frequency becomes lower. Assuming that the resonance frequency is not changed the length of the strip line 50 becomes shorter. Accordingly, this makes the manufacturing cost reduced. The strip line 50 and parallel strip lines 51 are formed by photolithographic process. Thus, they are accurately formed so that the resonance frequency is accurate. If a resonance frequency of a manufactured resonators deviates from a desired value, it is easy to trim the resonance frequency by adjusting the length of the parallel strip line 51. Moreover, an unloaded Q factor of the resonator 5 is large because dielectric loss in the parallel strip lines 51 is smaller than that of the conventional resonator with a discrete capacitor.

Figure 6A:
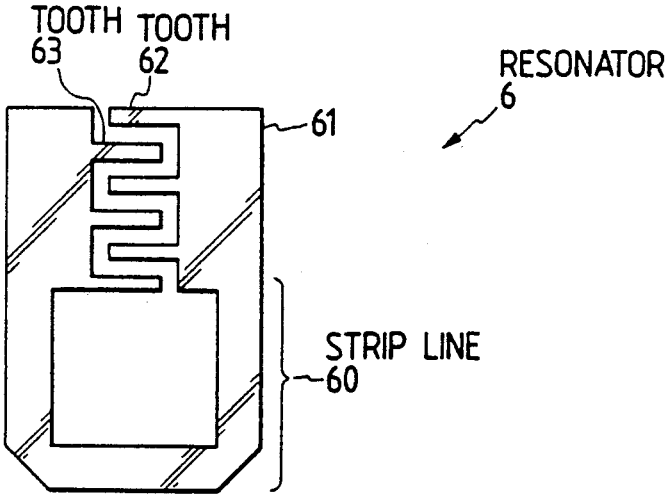
FIG. 6A is a plan view of a resonator of a sixth embodiment.
Figure 6B:
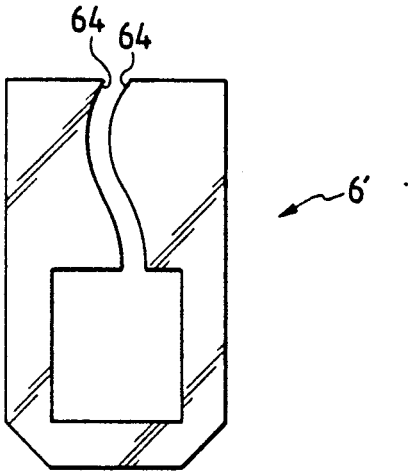
FIG. 6B is a plan view of a modification of a sixth embodiment.

FIG. 6A is a plan view of a sixth embodiment of a resonator 6. In FIG. 6A, the resonator 6 comprises a strip line 60 forming a substantially complete rectangular loop having spaced-apart ends, i.e., an open loop; and a capacitive means having two given length of parallel strip lines 61 spaced apart each other, ends of strip lines 61 being connected to the ends of the strip line 60 respectively, and arranged outside of the strip line 60. The strip lines 61 have teeth like a comb which are interlaced with each other, i.e., interdigitated with each other. Teeth may be formed in a wave shape. It is assumed that length of strip lines 61 is equal to that of the parallel strip lines 60 of the fifth embodiment, the strip lines 61 have a larger capacitance than the strip line 51. Therefore, dimensions of the resonator 6 becomes small. Assuming that length of strip lines 60 is equal to that of the strip lines 61 of the fifth embodiment and their capacitances are equal each other, space between the strip lines 61 becomes wider so that unevenness of resonance frequencies among manufactured resonators is smaller than that of the fifth embodiment of resonators 5. FIG. 6B is a plan view of modification of the sixth embodiment. In FIG. 6A, the resonator 6' has wave-shaped teeth 64. Similarly, teeth of the resonators 2 and 3 may be formed in wave shape, as shown in FIG. 6B.

Figure 7:
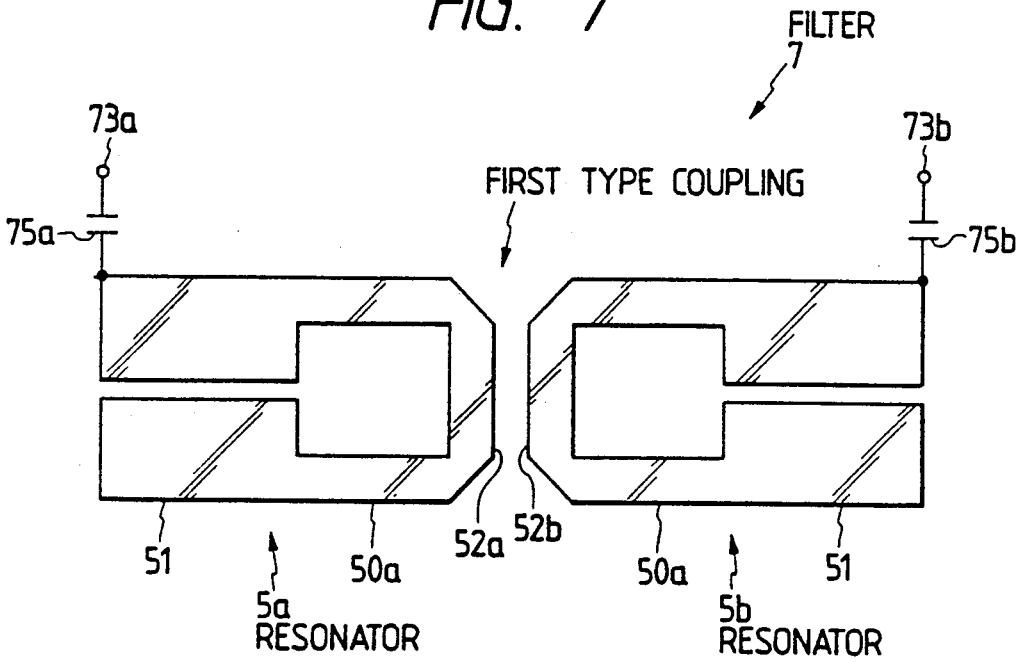
FIG. 7 is a plan view of a filter of seventh embodiment including resonators of fifth embodiment.

FIG. 7 is a plan view of a seventh embodiment of a filter 7. In FIG. 7, the filter 7 comprises two resonators 5*a* and 5*b* which are the same as the resonator 5 of the fifth embodiment which are formed with edges 52*a* and 52*b* of substantially complete rectangular loops 50*a* confronting to each other. Input/output terminals 73*a* and 74*a* are connected to outside corners of the parallel strip lines 51 through capacitor 75*a* and 75*b*. One resonators 5*a* is coupled to another resonator 5*b* by magnetic field through edges 52*a* and 52*b* of substantially complete rectangular loops 50*a*. This is referred to as first type of coupling between resonators. A high frequency signal applied to the input/output terminal 73*a* is transferred to the input/output terminal 74*a* through coupling capacitor 75*a*, resonator 5*a*, magnetic-field coupling between edges 52*a* and 52*b*, resonator 5*b*, and coupling capacitor 75*b* with a desired frequency component extracted from the input high frequency signal. Therefore, resonator 5*a* and 5*b* act as a band-pass filter having steep attenuation characteristics around high and low cut-off frequencies because input and output coupling is performed by capacitive coupling and coupling between the resonators 5*a* and 5*b* is made by magnetic-field coupling. Magnetic-field coupling shows an attenuation characteristic around a high cut-off frequency; capacitive coupling, an attenuation characteristic around a low cut-off frequency. Moreover, the filter 7 is miniaturized and manufactured at low cost because the it comprises the resonators 5*a* and 5*b* which are miniaturized, manufactured at a low cost, and show good reappearance of resonance frequency.

Figure 8:
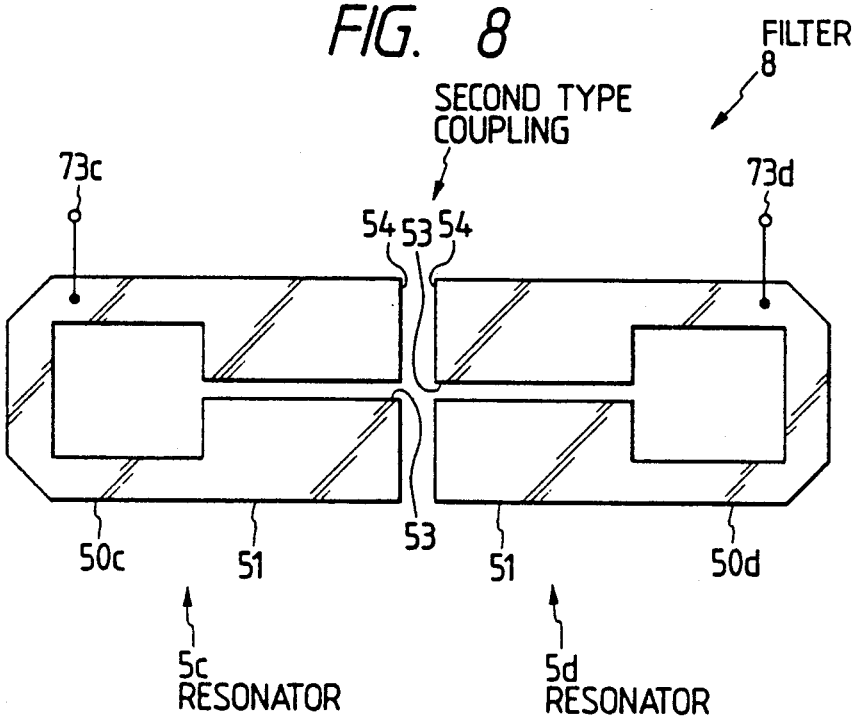
FIG. 8 is a plan view of a filter of eighth embodiment including resonators of fifth embodiment.

FIG. 8 is a plan view of a eighth embodiment of a resonator 8. In FIG. 8, the filter 8 comprises two resonators 5*c* and 5*d* which are the same as the resonator 5 of the fifth embodiment which are formed with edges 54 of parallel strip lines 51 confronted therebetween and a gap 53 between the parallel strip lines 51 of the resonator 5*c* is aligned with a gap 53 of the resonator 5*d*. Input/output terminals 73*c* and 74*d* are connected to corners of the strip lines 50*c* and 50*d* respectively through wires to obtain magnetic-field coupling. One resonators 5*c* is coupled to another resonators 5*b* by electric-field between the edge 54 of the resonators 5*c* and 5*d* . This is referred to as second type of coupling between resonators. A high frequency signal applied to the input/output terminal 73*c* is transferred to the input/output terminal 74*d* through the resonator 5*c*, electric-field coupling between edges 54, and resonator 5*d* with desired frequency components extracted from the input high frequency signal. Therefore, resonator 5*c* and 5*d* act as a band-pass filter having steep attenuation characteristics around high and low cut-off frequencies because input coupling is performed by magnetic-field coupling which shows good high frequency stop characteristic and coupling between the resonators 5*c* and 5*d* is made by electric-field coupling which shows good low frequency stop characteristic. Moreover, the filter 8 is miniaturized and manufactured at low cost because it comprises the resonators 5*c* and 5*d* which is miniaturized, manufactured at a low cost, and shows good reappearance of resonance frequency.

In the seventh and eighth embodiments, the filters 7 and 8 comprise two resonators respectively. However, a multi-stage filler can be made if desired. Coupling between resonators of multi-stage filter includes electric-field and magnetic-field coupling. Therefore, such multi-stage filter provides steeper attenuation characteristics around high and low cut-off frequencies than that of the filters 7 and 8. Moreover, such a multi-stage filter is useful for saving mounting space because it has a slender shape.

Figure 9:
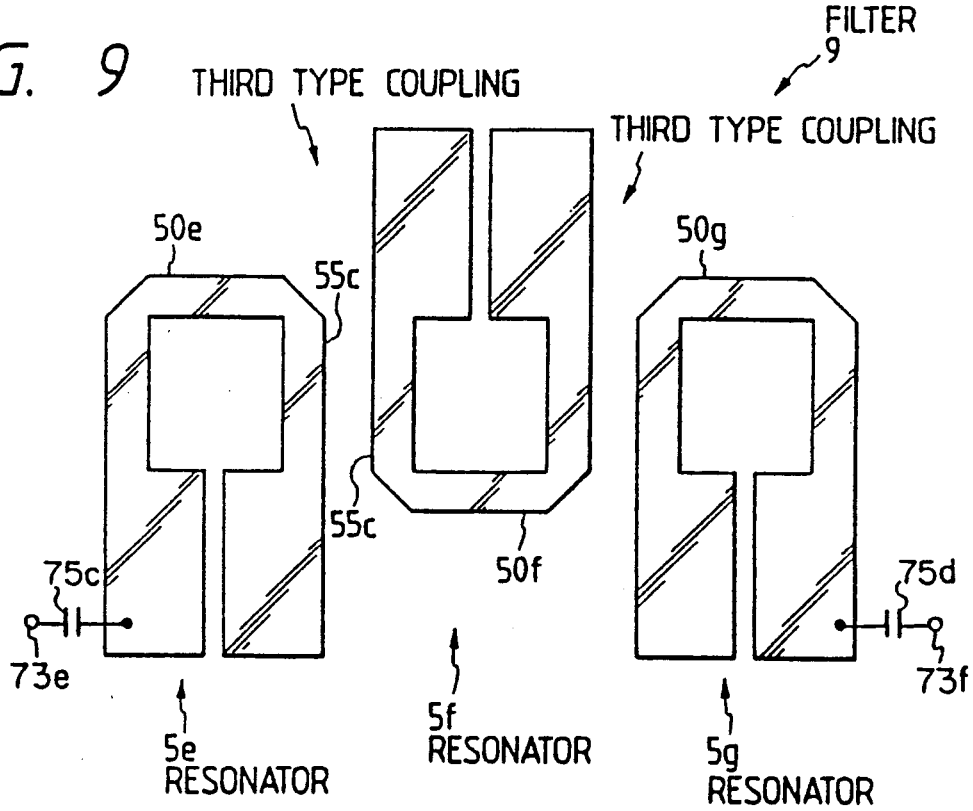
FIG. 9 is a plan view of a filter of ninth embodiment including resonators of fifth embodiment.

FIG. 9 is a plan view of a ninth embodiment of a resonator 9. In FIG. 9, the filter 9 comprises three resonators 5*e*, 5*f*, and 5*g* which are the same as the resonator 5 of the fifth embodiment. One of side limb 55*c* of the resonator 5*e* is arranged adjacent to but not in contact with one of side limb 55*c* of the resonator 5*f*. Similarly, another side limb 55*c* of the resonator 5*f* is arranged adjacent to but not in contact with a side limb of the resonator 5*g*. Input/output terminals 73*e* and 73*f* are connected to corners of the strip lines 50*e* and 50*g* respectively through capacitors 75*c* and 75*d* to obtain capacitive coupling. The resonators 5*e* is coupled to the resonator 5*f* by magnetic-field through side limbs 55*c* of strip lines 50*e* and 50*f*. This is referred to as third type of coupling between resonators. A high frequency signal applied to the input/output terminal 73*e* is transferred to the input/output terminal 73*f* through the resonator 5*e*, magnetic-field coupling between side limbs 55*c* of strip lines 50*e*, 50*f*, and 50*g* with desired frequency components extracted from the input high frequency signal. Therefore, resonator 5*e*, 5*f*, and 5*g* act as a band-pass filter having steep attenuation characteristics around high and low cut-off frequencies because input coupling is performed by capacitive coupling which shows good low frequency stop characteristic and coupling between the resonators 5*e*, 5*f*, and 5*g* is made by magnetic-field coupling which shows good high frequency stop characteristic. Moreover, the filter 9 is miniaturized and manufactured at low cost because it uses the resonators 5*e*, 5*f*, and 5*g* which are miniaturized, manufactured at a low cost, and shows good reappearance of resonance frequency.

Figure 10:
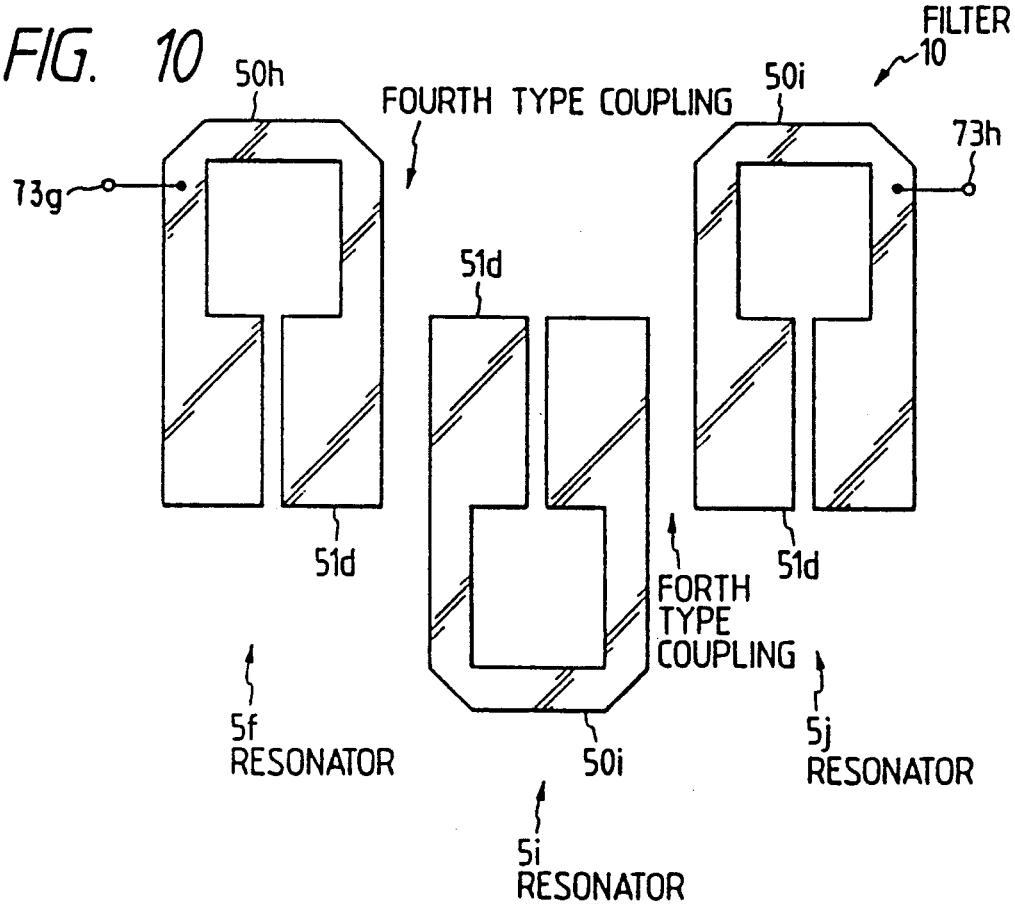
FIG. 10 is a plan view of a filter of tenth embodiment including resonators of fifth embodiment.

FIG. 10 is a plan view of a tenth embodiment of a filter 10. In FIG. 10, the filter 10 comprises three resonators 5*h*, 5*i*, and 5*j* which are the same as the resonator 5 of the fifth embodiment. A side edge of one of parallel strip line 51*d* of the resonator 5*i* is arranged adjacent to but not in contact with a side edge of one of parallel strip line 51*d* of the resonator 5*h*. Similarly, a side edge of another parallel strip line 51*d* of the resonator 5*i* is arranged adjacent to but not in contact with a side edge of one of parallel strip line 51*d* of the resonator 5*j*. This is referred to as fourth type of coupling between resonators. Input/output terminals 73*g* and 73*h* are connected to corners of the strip lines 50*h* and 50*j* respectively through conductors to obtain magnetic-field coupling, as shown. The resonators 5*h* and 5*j* are coupled to the resonator 5*i* through side edges of parallel strip lines 51*d* of the resonator 5*h*, 5*i*, and 5*j* by electric-field. A high frequency signal applied to the input/output terminal 73*g* is transferred to the input/output terminal 73*h* through the resonator 5*h*, electric-field coupling between side edges of parallel strip lines 51*d* of the resonators 5*h*, 5*i*, and 5*j* with a desired frequency component extracted from the input high frequency signal. Therefore, resonator 5*h*, 5*i*, and 5*j* act as a band-pass filter having steep attenuation characteristics around high and low cut-off frequencies because input coupling is performed by magnetic-field coupling which shows good low frequency stop characteristic and coupling between the resonators 5*h*, 5*i*, and 5*j* is made by electric-field coupling which shows good low frequency stop characteristic. Moreover, the filter 10 is miniaturized and manufactured at low cost because the it uses the resonators 5*h*, 5*i*, and 5*j* which are miniaturized, manufactured at a low cost, and shows good reappearance of resonance frequency.

In the ninth and tenth embodiments, the filters 9 and 10 comprise three resonators respectively. However, a multi-stage filter having more resonators can be obtained if desired. Coupling between resonators of such multi-stage filter includes electric-field and magnetic-field coupling so that steep attenuation characteristic can be obtained.

Figure 11:
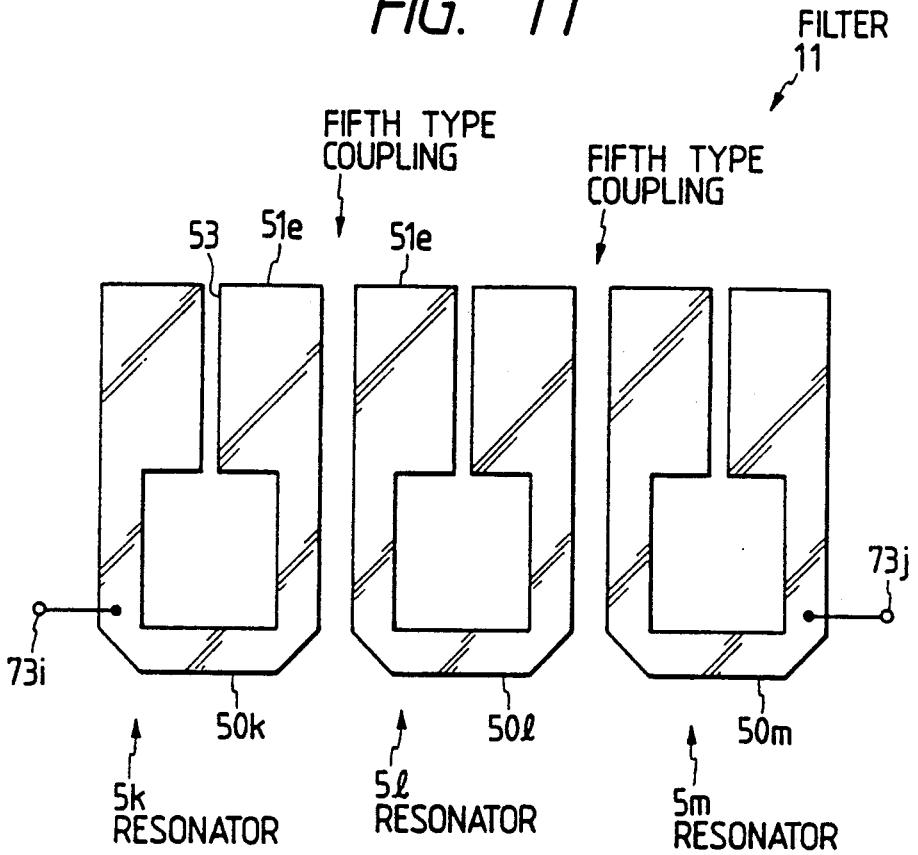
FIG. 11 is a plan view of a filter of eleventh embodiment including resonators of fifth embodiment.

FIG. 11 is a plan view of an eleventh embodiment of a resonator 11. In FIG. 11, the filter 11 comprises four resonators 5*k*, 5*l*, and 5*m* which are the same as the resonator 5 of the fifth embodiment. A side edge of the resonator 5*k* is arranged adjacent to but not in contact with one side edge of resonator 5*l*. Similarly, another side edge of resonator 5*l* is arranged adjacent to but not in contact with a side edge of the resonator 5*m*. The resonators 50*k*, 50*l*, and 50*m* are aligned and so arranged that directions of gaps of the resonators 5*k*, 5*l*, and 5*m* when viewed from centers of the loop strip lines 50*k*, 50*l*, and 50*m* respectively are coincident with each other. Input/output terminals 73*i* and 73*j* are connected to corners of the strip lines 50*k* and 50*m* respectively through conductors to obtain magnetic-field coupling. The resonators 5*k* and 5*l* and the resonators 5*l* and 5*m* are coupled to each other respectively through side edges of the resonator 5*k*, 5*l*, and 5*m* by electromagnetic field. This is referred to as fifth type of coupling between resonators. A high frequency signal applied to the input/output terminal 73*k* is transferred to the input/output terminal 73*l* with a desired frequency component extracted from the input high frequency signal. Therefore, resonator 5*k*, 5*l*, and 5*m* act as a band-pass filter.

Generally, in a one-end-grounded resonator like the resonator 5, if electrical length is 90° coupling between resonators is not obtained because magnetic-field coupling cancels out electric-field coupling. However, in this embodiment, coupling is obtained by that an characteristic impedance ratio of one of parallel strip line 51*e* to the strip line 50*k* is made less than one, i.e., electrical length is made less than 90°. Such characteristic impedance ratio can be easily obtained in this embodiment because the parallel strip line 51*e* is wider than the strip line 50*k*. The resonator 5 is one of one-end grounded resonator because the center of strip line 50*k* is equivalently grounded. Moreover, degree of coupling between resonators 5*k*, 5*l*, and 5*m* can be changed by changing the characteristic impedance ratio of the strip line 50*k* to one of parallel strip line 51*e* in addition to changing width of gaps between the resonators 5*k*, 5*l*, and 5*m*. Therefore, degree of coupling between the resonators 5*k*, 5*l*, and 5*m* can be adjusted with higher degree of freedom. Further, such coupling of the filter 11 can save a space compared with the case of filters 7 to 10. Thus, the filter 11 is further miniaturized.

Figure 12:
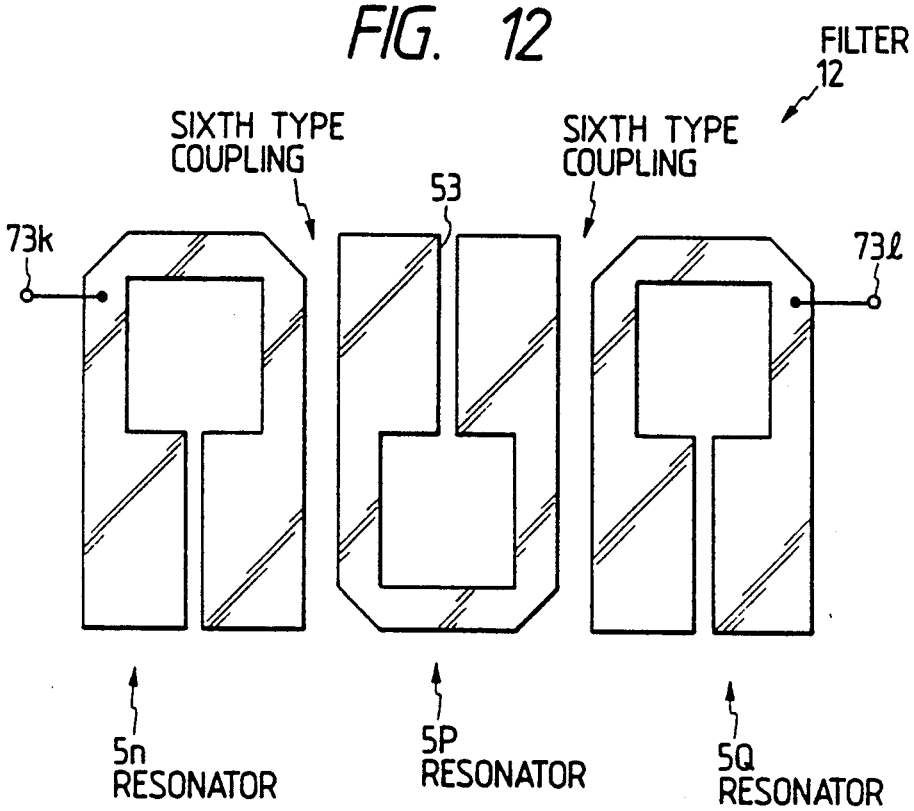
FIG. 12 is a plan view of a filter of twelfth embodiment including resonators of fifth embodiment.

FIG. 12 is a plan view of an twelfth embodiment of a resonator 12. In FIG. 12, the filter 12 has the same structure as the resonator 11 except in that the direction of the gap 53 of the resonator 5*p* is different from those of the resonators 5*n* and 5*q*. Magnetic-field coupling between the resonator 5*p* and 5*n* or 5*q* can be obtained by a similar way described in the eleventh embodiment. However, degree of coupling between resonators is different from that of eleventh embodiment because the directions of gaps 53 are different from each other.

Therefore, the direction of resonators can change the degree of coupling between resonators. This is referred to as sixth type of coupling between resonators. Further, the above-mentioned arrangement of the resonators 5n, 5p, and 5q can save a space compared with filters 7 to 10. Thus, the filter 12 is further miniaturized.

Figure 13:
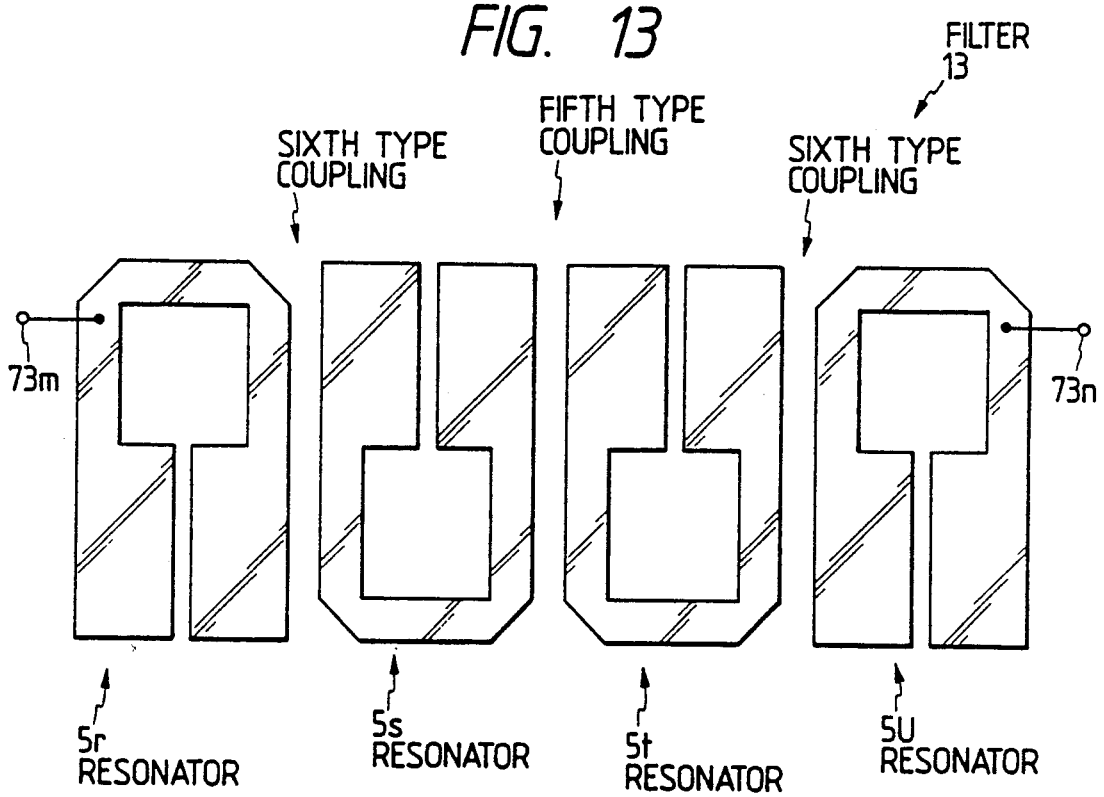
FIG. 13 is a plan view of a filter of thirteenth embodiment including resonators of fifth embodiment.

FIG. 13 is a plan view of an thirteenth embodiment of the present invention. In FIG. 13, a filter 13 comprises four resonators 5r, 5s, 5t and 5u which are the same as the resonator 5 of the fifth embodiment. Coupling between resonators 5r, 5s, 5t, and 5v is performed by fifth type coupling between resonators 5s and 5t and by sixth type coupling between the resonators 5r and 5s and between the resonators 5t and 5u.

If a filter having resonators more than four, generally, different degrees of coupling between resonators are required for obtain good frequency characteristics. In FIG. 13, the filter 13 is so designed that degree of coupling between the resonator 5r and 5s is equal to that between the resonator 5t and 5u but degree of coupling between the resonators 5s and 5t is different from them. Since there are two types of coupling in the filter 13, the filter 13 can provide easy designing of filter characteristic. Further, such coupling of the filter 13 can save a space because the resonators 5r, 5s, 5t, and 5u are aligned. Thus, the filter 13 is miniaturized.

Figure 14:
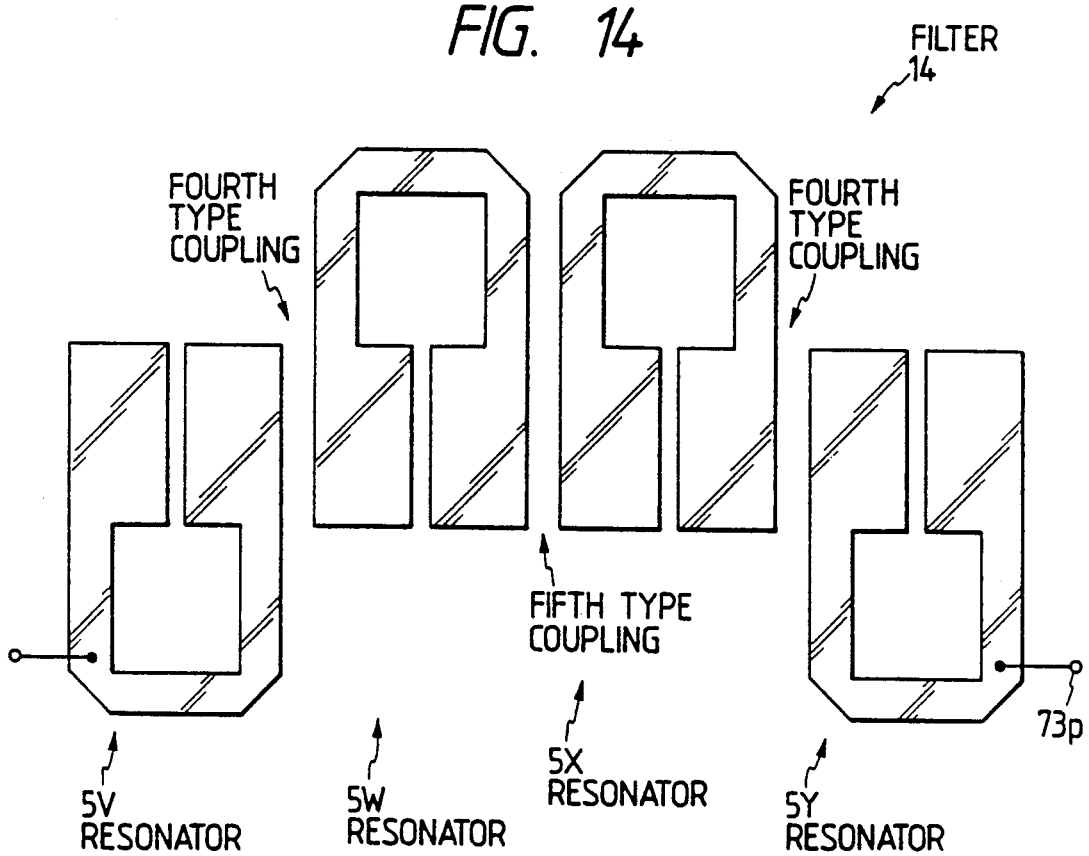
FIG. 14 is a plan view of a filter of fourteenth embodiment including resonators of fifth embodiment.

FIG. 14 is a plan view of an fourteenth embodiment of a resonator 14. In FIG. 14, the filter 14 comprises four resonators 5v, 5w, 5x and 5y which are the same as the resonator 5 of the fifth embodiment. Coupling between resonators 5v, 5w, 5x, and 5y is performed by fifth type coupling between resonators 5w and 5x and by fourth type coupling between the resonators 5v and 5w and between the resonators 5x and 5y.

The filter 14 has steep attenuation characteristics around high and low cut-off frequencies because input coupling is performed by magnetic-field coupling which shows good low frequency stop characteristic and coupling between the resonators 5v and 5w and between 5x and 5y is electric-field coupling which shows good low frequency stop characteristic.

Figure 15:
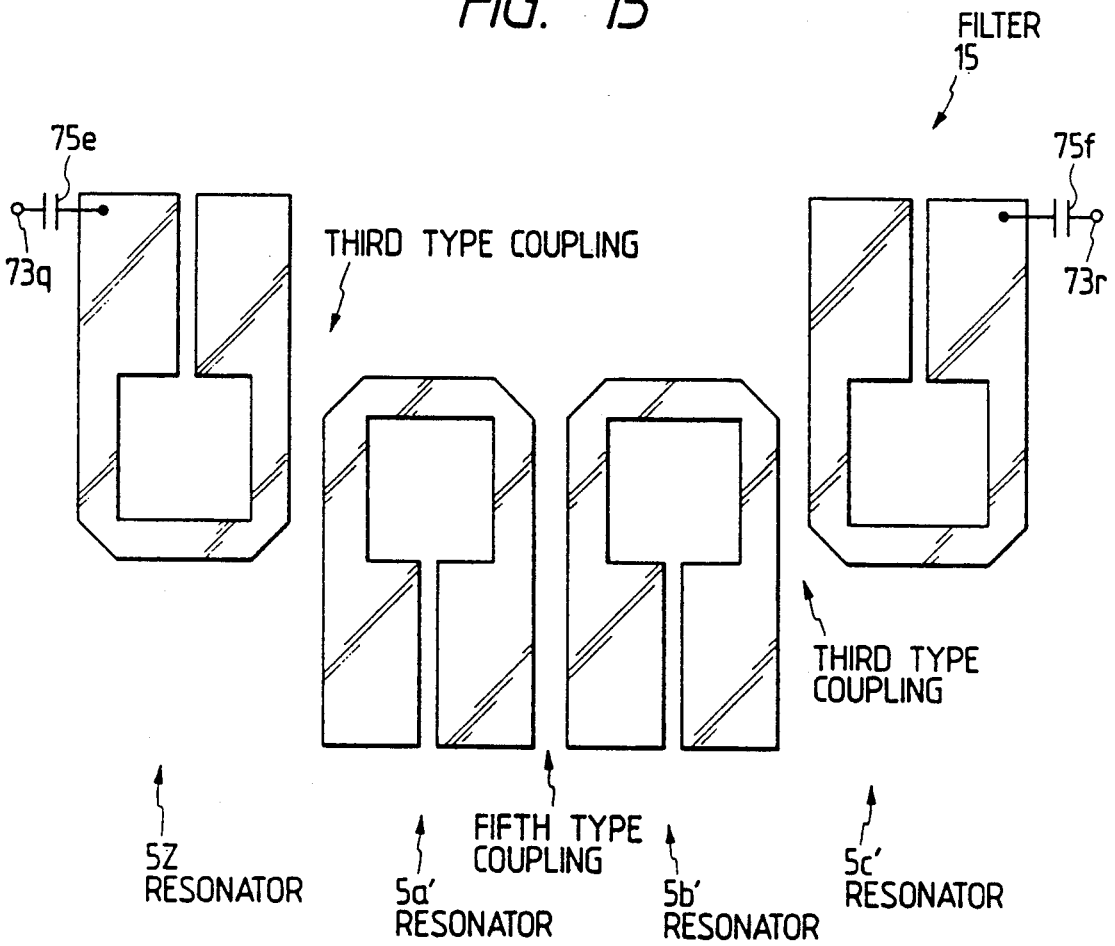
FIG. 15 is a plan view of a filter of fifteenth embodiment including resonators of fifth embodiment.

FIG. 15 is a plan view of an fifteenth embodiment of a filter 15. In FIG. 15, the filter 15 comprises four resonators 5z, 5a', 5b' and 5c' which are the same as the resonator 5 of the fifth embodiment. Coupling between resonators is performed by fifth type coupling between resonators 5a' and 5b' and by third type coupling between the resonators 5z and 5a' and between the resonators 5b' and 5c'.

The filter 15 has steep attenuation characteristics around high and low cut-off frequencies because input coupling is performed by capacitive coupling which shows good low frequency stop characteristic and coupling between the resonators 5z, 5a', 5b' and 5c' is made by magnetic-field coupling which shows good high frequency stop characteristic.

In the above-mentioned embodiments from seventh to fifteenth, the resonators from 5a to 5z and 5a' to 5c' which are the same as the resonator 5 of the fifth embodiment are used. However, the resonator 6 can be used in these embodiment or resonators 5 and 6 may be used in filters 7 to 15.

As mentioned-above, the present invention improves reappearance of resonance frequency of the resonator and accuracy and cost in manufacturing of the resonator because a capacitor necessary for the conventional ring-shaped resonator is replaced with capacitive means comprises strip lines 11, 22, 23, 31, 32, 61, or 62 which can be formed by photolithographic technique with high manufacturing accuracy.

Further, if a resonance frequency of a manufactured resonators deviates from a desired value, it is easy to trim the resonance frequency by adjusting the length of the parallel strip line. Moreover, an unloaded Q factor of the resonators are large because dielectric losses in the capacitive means, i.e., parallel strip lines, are smaller than that of the conventional resonators with a discrete capacitor.

The parallel strip lines 51 of embodiments from five to fifteenth are so designed that a square root of a product of odd and even mode characteristic impedances $Z_oo$ and $Z_oe$ of parallel strip lines 51 is smaller than a characteristic impedance $Z_o$ of a loop strip line. This makes the dimensions of the resonator 5 becomes further smaller.

According to the present invention, the filters including resonators 5a to 5z and 5a' to 5c' of the invention are miniaturized, manufactured at low cost, and show accurate frequency characteristic because the filters 5 to 15 use the resonators are miniaturized and manufactured at a low cost, and further show good reappearance of resonance frequency.

The invention provides various types of couplings, namely; magnetic-field coupling with steep high frequency stop characteristic; capacitive and electric-field coupling with steep low frequency stop characteristics; and electromagnetic-field coupling between the side edges of two resonators where characteristic impedances are changed stepwise, the electromagnetic-field coupling showing higher degree of freedom in adjusting degree of coupling between resonators. Therefore, the filter according to the invention can have steep frequency characteristic by the combining various types of coupling and can be miniaturized.

What is claimed is:

1. A resonator having a strip line, said strip line comprising:

(a) a first portion so curved to form an open loop; and (b) two second portions, each provided to each end of said first portion, said two second portions facing each other with a given distance therebetween, said distance and length of said second portion being determined such that necessary capacitance is provided, each of said two second portions having a large area than said first portion such that an additional capacitance is provided between each of said second portions and a grounded plane supporting said strip line through a dielectric substance.

2. A resonator as claimed in claim 1, wherein said second portions are formed inside said open loop.

3. A resonator as claimed in claim 1, wherein said first portion is formed in a substantially annular shape.

4. A resonator as claimed in claim 3, wherein said two second portions are formed in a semicircle shape, cord of said semicircle shape of two second portions confronting each other.

5. A resonator as claimed in claim 1, wherein each of said second portions has teeth so that said second portions have interdigital shape.

6. A resonator as claimed in claim 5, wherein teeth of each of said second portions are formed to have wave shape.

7. A resonator as claimed in claim 5, further comprising: a first terminal at said first portion.

8. A resonator as claimed in claim 5, further comprising: a first terminal at one of said ends of first portion and a capacitor connected to said first terminal.

9. A resonator having a substantially U-shaped strip line, said strip line comprising:

(a) a first portion so curved to form an open loop; and (b) two second portions each of said two second portions formed to have a larger width than said first portion, said each provided to each end of said first portion, said two second portions facing each other with a given distance therebetween, said distance and length of said second portion being determined such that necessary capacitance is provided.

10. A resonator as claimed in claim 9, wherein said first and second portions are formed such that a root of a product of even and odd mode characteristic impedances of said each of said second portion is smaller than an characteristic impedance of said first portion.

11. A resonator as claimed in claim 9, wherein said second portions have straight edges arranged in parallel to face each other.

12. A resonator as claimed in claim 9, wherein each of said second portions has teeth so that said second portions have interdigital shape.

13. A resonator as claimed in claim 12, wherein teeth of each of said second portions are formed to have wave shape.

14. A filter including a plurality of resonators, each resonator having a substantially U-shaped strip line, said strip line comprising:

(a) a first portion curved so as to form an open loop; and (b) two second portions, each of said two second portions formed to have a larger width than said first portion, said each of said two second portions provided at each end of said first portion, said two second portions facing each other with a given distance therebetween, said distance and length of said second portion being determined such that a desired capacitance is provided, said plurality of resonators serially arranged so as to obtain coupling between two consecutive resonators through said first portions of said plurality of resonators.

15. A filter including plurality of resonators, each resonator having a substantially U-shaped strip line, said strip line comprising:

(a) a first portion curved so as to form an open loop; and (b) two second portions, each of said two second portions formed to have a larger width than said first portion, said each of said two second portions provided at each end of said first portion, said two second portions facing each other with a given distance therebetween, said distance and length of said second portion being determined such that a desired capacitance is provided, said plurality of resonators arranged so as to obtain coupling between two consecutive resonators through said second portions respectively.

16. A filter including plurality of resonators, each resonator having a substantially U-shaped strip line, said strip line comprising:

(a) a first portion curved so as to form an open loop; and (b) two second portions, each of said two second portions formed to have a larger width than said first portions, said each of said two second portions provided at each end of said first portion, said two second portions facing each other with a given distance therebetween, said distance and length of said second portion being determined such that a desired capacitance is provided, said plurality of resonators arranged so as to obtain coupling between two consecutive resonators through said first and second portions.

17. A filter including plurality of resonators, each resonator having a substantially U-shaped strip line, said strip line comprising:

(a) a first portion curved so as to form an open loop; and (b) two second portions, each of said two second portions formed to have a larger width than said first portion, said each of said two second portions provided at each end of said first portion, said two second portions facing each other with a given distance therebetween, said distance and length of said second portion being determined such that a desired capacitance is provided, said plurality of resonators so arranged that one group of adjacent pairs of said plurality of resonators are coupled between two consecutive resonators through said second portions, and another group of adjacent pairs of said plurality of resonators are coupled between two consecutive resonators through said first portions.

18. A filter including plurality of resonators, each resonator having a substantially U-shaped strip line, said strip line comprising:

(a) a first portion curved so as to form an open loop; and (b) two second portions, each of said two second portions formed to have a larger width than said first portion, said each of said two second portions provided at each end of said first portion, said two second portions facing each other with a given distance therebetween, said distance and length of said second portion being determined such that a desired capacitance is provided, said plurality of resonators serially so arranged that coupling between given adjacent pairs of said plurality of resonator is selected from couplings between said first portions, between said second portions, and first and second portions of said adjacent pairs.

* * * * *